United States Patent [19]

Pomroy

[11] Patent Number: 4,809,868

[45] Date of Patent: Mar. 7, 1989

[54] STORAGE AND COOKING CONTAINER WITH LID RELEASE TAB

[75] Inventor: James F. Pomroy, St. Paul, Minn.

[73] Assignee: Plastics, Inc., St. Paul, Minn.

[21] Appl. No.: 142,502

[22] Filed: Jan. 11, 1988

[51] Int. Cl.[4] ..... B65D 43/26

[52] U.S. Cl. ..... 220/260; 220/355; 220/263; 150/0.5; 150/55

[58] Field of Search ..... 220/260, 262, 339, 306, 220/263, 351, 354, 355, 356; 215/301; 150/0.5

[56] References Cited

U.S. PATENT DOCUMENTS

| | | | |
|---|---|---|---|
| 2,780,385 | 2/1957 | Tupper | 220/43 |
| 2,789,607 | 4/1957 | Tupper | 150/0.5 |
| 2,816,589 | 12/1957 | Tupper | 150/0.5 |
| 3,032,927 | 5/1962 | Kobs | 47/37 |
| 3,044,610 | 7/1962 | Tupper | 206/46 |
| 3,155,233 | 11/1964 | Tupper | 206/46 |
| 3,545,642 | 12/1970 | Swett | 220/355 |
| 3,732,909 | 5/1973 | Rooke et al. | 150/0.5 |
| 3,794,207 | 2/1974 | Hunt | 220/339 X |
| 3,957,097 | 5/1976 | Swett | 150/0.5 |
| 4,165,020 | 8/1979 | Hoselton | 220/306 |
| 4,223,800 | 9/1980 | Fishman | 220/352 |
| 4,412,630 | 11/1983 | Daenen | 220/353 |
| 4,471,880 | 9/1984 | Taylor et al. | 220/306 |
| 4,602,719 | 7/1986 | Borst | 220/260 X |

*Primary Examiner*—Steven M. Pollard

*Attorney, Agent, or Firm*—Flehr, Hohbach, Test, Albritton & Herbert

[57] ABSTRACT

Plastic food storage and cooking container having an airtight seal between the lid and the bowl of the container, with a release tab for lifting the lid away from the bowl with a prying action.

9 Claims, 1 Drawing Sheet

STORAGE AND COOKING CONTAINER WITH LID RELEASE TAB

This invention pertains generally to plastic containers for the storage and cooking of food products, and more particularly to a container having a release tab for separating the lid from the bowl of the container.

In recent years, plastic containers have been used widely in the storage and cooking of food products, particularly when the food products are cooked or reheated in a microwave oven. Such containers typically have a bowl which may be of any convenient size and shape and a lid which is removably mounted on the bowl. In order to keep ambient air away from the food product within the container, the lid must form a tight seal with the bowl, and when the lid fits tightly, it can be difficult to remove.

It is in general an object of the invention to provide a new and improved container for use in the storage and cooking of food products.

Another object of the invention is to provide a container of the above character in which the lid is readily removed from the bowl.

Another object of the invention is to provide a container of the above character in which the bowl is formed of a thermoset plastic material and can be utilized in conventional ovens as well as microwave ovens.

These and other objects are achieved in accordance with the invention by providing a container comprising a bowl having a peripheral side wall terminating in an upper rim with a flange projecting laterally from the side wall below the rim, a lid removably mounted on the bowl with a peripheral portion of the lid in sealing engagement with the rim of the bowl, a tab projecting laterally from the peripheral portion of the lid, and a cam surface on the underside of the tab engagable with the flange for lifting the lid away from the bowl upon depression of the tab. In the disclosed embodiment, the bowl is fabricated of a thermoset plastic material, the lid is fabricated of a thermoplastic material, and the bowl is suitable for use in both microwave ovens and conventional ovens.

Figure 1:
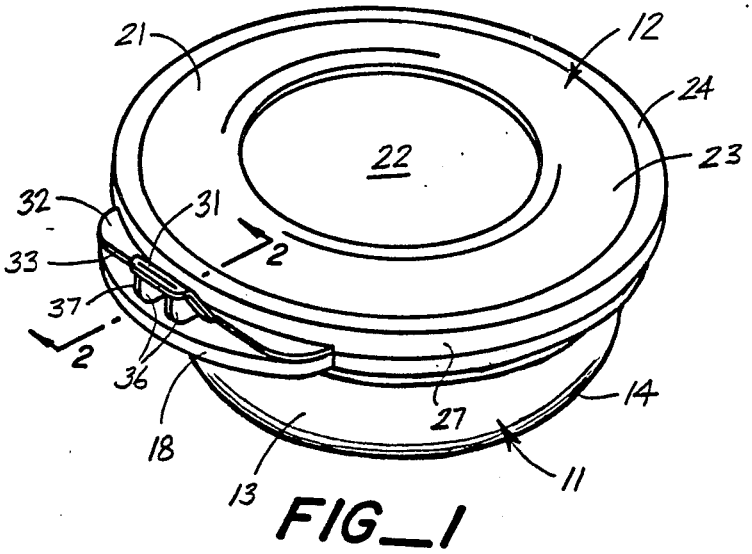
FIG. 1 is an isometric view of one embodiment of a container for storing and cooking food products in accordance with the invention.

As illustrated in the drawings, the container comprises a bowl 11 and a lid 12 which is removably mounted on the bowl. In the embodiment illustrated, the container is generally round or circular in plan, but it can be of any desired size and shape, such as square, rectangular or oval-shaped.

Figure 2:
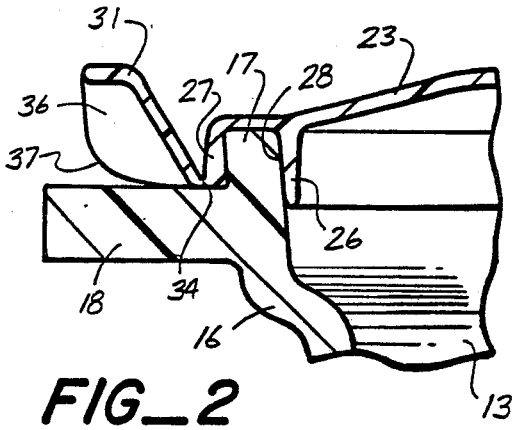
FIG. 2 is an enlarged, fragmentary sectional view taken along line 2—2 in FIG. 1.
Figure 3:
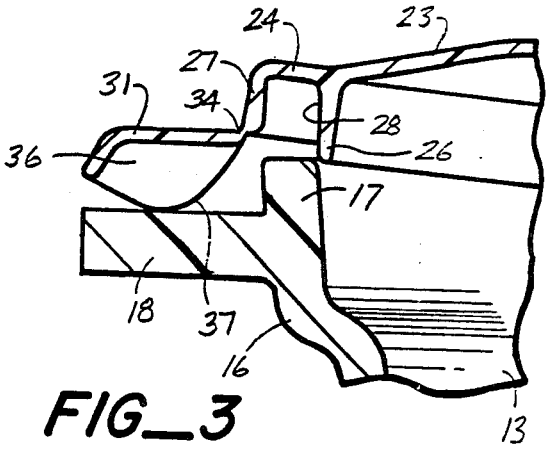
FIG. 3 is an enlarged, fragmentary sectional view similar to FIG. 2, showing the release tab in a depressed position and the lid lifted away from the rim of the bowl.

The bowl has a peripheral side wall 13 and a relatively flat bottom wall (not shown). The lower portion of the side wall is rounded, as indicated at 14, and the bottom wall has a small depending peripheral bead or flange (not shown) which serves as a base for the bowl. The upper portion of the side wall curves outwardly and upwardly, as indicated at 16, and terminates in an upstanding rim 17. As best seen in FIGS. 2 and 3, the rim is inclined by a few degrees in an upward and outward direction and consequently is of greater diameter toward the top.

A flange 18 extends in an outward direction from side wall 13 at the base of rim 17 on one side of the bowl. As discussed more fully hereinafter, the principal function of this flange is to assist in removal of the lid from the bowl. If desired, a similar flange can be provided on the opposite side of the bowl, and the two flanges can be utilized as handles for lifting and carrying the bowl.

In the embodiment illustrated, bowl 11 is formed as a unitary structure and is fabricated of a thermoset plastic material, such as a modified polyester, which is suitable for use at temperatures as high as 400–500 degrees F. Such a bowl is suitable for use in both microwave and conventional ovens, and can also be used in a refrigerator or a freezer. A bowl fabricated of such a material is relatively rigid.

The top wall 21 of lid 12 has a recessed central area 22 surrounded by an arched section 23, with a relatively flat annular outer section 24 at the periphery of the arched section. The diameter of recessed area 22 is slightly greater than the outer diameter of the bead or flange on the underside of bowl 11 to facilitate stacking of the containers with the bead or flange of one container being received in the recessed area in the lid of the container below.

A pair of concentric, generally cylindrical flanges depend from the outer portion of top wall 21 and form a downwardly opening U-shaped channel or groove 28 in which the rim 17 of the bowl is received when the lid is installed on the bowl. Outer flange 27 is tapered, as illustrated in FIGS. 2 and 3, to provide a snap fit with the inclined rim of the bowl. The lid is fabricated of a relatively resilient thermoplastic material, and the resiliency of flange 27 forms an airtight seal between the lid and the rim of the bowl.

The lid has a release tab 31 for separating the lid from the bowl. The release tab is hingedly connected to a flange 32 which projects laterally from the lower margin of outer flange 27. The outer edge 33 of flange 32 is generally tangential to the outer surface of flange 27, and the hinged connection is made by a thin web 34 between the outer edge of flange 32 and the inner edge of tab 31.

A pair of cam members 36 having rounded surfaces 37 engageable with the upper surface of flange 18 are provided on the underside of release tab 31. The cam surfaces are engageable with the upper surface of flange 18 for lifting the lid away from the bowl upon depression of the tab.

In the embodiment illustrated, lid 12 is formed as an integral structure by a suitable process such as injection molding, and web 34 is formed as an area of reduced thickness between flange 32 and tab 31. This hinge structure has an inherent resiliency which tends to hold cam surfaces 37 against the upper surface of flange 18 when the lid is in its covering position on the bowl.

Operation and use of the container is as follows. Lid 12 is installed on bowl 11 by placing the lid on top of the bowl with groove 28 aligned with rim 17 and release tab 31 aligned with flange 18. The lid is then pressed onto the bowl until rim 17 snaps into groove 28. With the lid thus installed, an airtight seal is formed between the rim of the bowl and the peripheral groove of the lid.

The lid is removed by depressing tab 31 so that cam surface 37 rocks on the upper surface of flange 18, thereby lifting the lid away from the rim of the bowl with a prying action. The tab is readily depressed by grasping the tab and the flange with the thumb and forefinger of a hand and squeezing them together. In one presently preferred embodiment, the lid has sufficient rigidity to pivot as a unit out of engagement with rim 17 as the tap is depressed. If the lid is fabricated of a more flexible material, only a portion of the lid in the vicinity of the tab may be lifted by depression of the tab. However, the remainder of the lid is easy to disengage from the rim once the initial portion as been separated.

The container can be used for the storage of foods at room temperature, in a refrigerator or in a freezer. It can also be used for heating or cooking foods in a conventional oven or in a microwave oven. When the container is heated in a conventional oven, the lid is removed since the thermoplastic material of which is fabricated may not be suitable for use at the relatively high temperatures (e.g. 400–500 degrees F.) in a conventional oven. The lid can be left on the bowl in a microwave oven, but it should be loosened to prevent a buildup of pressurized steam within the container. The lid can be fabricated of a transparent material to permit observation of the food product within the container without removal of the lid.

It is apparent from the foregoing that a new and improved container has been provided for the storage and cooking of food products. While only one presently preferred embodiment has been described in detail, as will be apparent to those familiar with the art, certain changes and modifications can be made without departing from the scope of the invention as defined by the following claims.

I claim:

1. In a container for use in the storage and/or cooking of a food product: a bowl having a peripheral side wall terminating in an upper rim with a flange having a generally planar upper surface projecting laterally from the side wall below the rim, a lid removably mounted on the bowl with a peripheral portion of the lid in sealing engagement with the rim of the bowl, a tab hingedly connected to the peripheral portion of the lid and projecting laterally therefrom, and a curved cam surface on the underside of the tab in rocking engagement with the planar surface of the flange for lifting the peripheral portion of the lid away from the bowl upon depression of the tab.

2. The container of claim 1 wherein the bowl is fabricated of a thermoset plastic material, and the lid is fabricated of a thermoplastic material.

3. The container of claim 1 wherein the lid and the tab are formed as a unitary structure of a thermoplastic material with an area of reduced thickness forming the hinged connection between the tab and the peripheral portion of the lid.

4. The container of claim 1 wherein the curved cam surface is formed on a cam member which projects in a downward direction from the underside of the tab.

5. In a container: a bowl having a peripheral side wall terminating in an upper rim with a flange projecting laterally from the side wall below the rim, a lid removably mounted on the bowl and having a downwardly opening peripheral groove in which the rim of the bowl is received in sealing engagement, with the side walls of the rim and the groove being upwardly and outwardly inclined so that the rim snaps into the groove to secure the lid to the bowl, a tab projecting laterally from the peripheral portion of the lid, and a cam surface on the underside of the tab and engageable with the flange for lifting the lid away from the bowl upon depression of the tab.

6. The container of claim 5 wherein the bowl is fabricated of a thermoset plastic material, and the lid is fabricated of a thermoplastic material.

7. The container of claim 5 wherein the tab is hingedly connected to the peripheral portion of the lid.

8. The container of claim 7 wherein the lid and the tab are formed as a unitary structure of a thermoplastic material with an area of reduced thickness forming the hinged connection between the tab and the peripheral portion of the lid.

9. The container of claim 5 wherein the cam surface is formed on a cam member which projects in a downward direction from the underside of the tab.

* * * * *